US007517304B1

(12) United States Patent
Swanson et al.

(10) Patent No.: US 7,517,304 B1
(45) Date of Patent: Apr. 14, 2009

(54) EXERCISE APPARATUS WITH CARTRIDGE LOADING PULLEY SWIVEL

(75) Inventors: Thor S. Swanson, Bensenville, IL (US); Aaron J. Miller, Brooklyn Center, MN (US); Lee M. Atwood, Burnsville, MN (US); Westin W. Nelson, Dayton, MN (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/626,892

(22) Filed: Jan. 25, 2007

(51) Int. Cl.
*A63B 21/062* (2006.01)

(52) U.S. Cl. ..... 482/102; 482/99; 482/100

(58) Field of Classification Search ..... 482/97–103; 29/892, 892.1, 898.07, 434; 403/113, 116
See application file for complete search history.

(56) References Cited

U.S. PATENT DOCUMENTS

| | | | | | |
|---|---|---|---|---|---|
| 2,318,839 | A * | 5/1943 | Crickmer | 403/37 |
| 2,684,259 | A * | 7/1954 | Schwartz | 403/116 |
| 3,022,096 | A * | 2/1962 | Schwartz | 285/153.3 |
| 3,263,266 | A * | 8/1966 | Rabelos et al. | 16/44 |
| 3,961,437 | A * | 6/1976 | Lewis | 43/27.4 |
| 4,348,784 | A * | 9/1982 | Fontana | 16/36 |
| 4,709,918 | A * | 12/1987 | Grinblat | 482/70 |
| 4,809,972 | A | 3/1989 | Rasmussen et al. | |
| 4,900,018 | A | 2/1990 | Ish, III et al. | |
| 5,029,844 | A * | 7/1991 | Pollich | 271/245 |
| 5,328,297 | A * | 7/1994 | Handford | 405/184 |
| 5,496,236 | A * | 3/1996 | Buonauito | 482/57 |
| 5,742,977 | A * | 4/1998 | Hoofe, III | 16/30 |
| 5,873,847 | A * | 2/1999 | Bennett et al. | 602/16 |
| 6,443,877 | B1 * | 9/2002 | Hoecht et al. | 482/103 |
| 6,447,430 | B1 * | 9/2002 | Webb et al. | 482/98 |
| 7,108,641 | B2 * | 9/2006 | Pertegaz-Esteban | 482/139 |
| 7,179,209 | B2 * | 2/2007 | Sechrest et al. | 482/103 |
| 7,344,144 | B2 * | 3/2008 | Lin | 280/47.34 |
| 2003/0100413 | A1 * | 5/2003 | Huang | 482/100 |
| 2003/0176261 | A1 * | 9/2003 | Simonson et al. | 482/103 |
| 2004/0226773 | A1 * | 11/2004 | Beaver et al. | 182/163 |
| 2006/0189457 | A1 * | 8/2006 | Ripley | 482/99 |
| 2007/0093365 | A1 * | 4/2007 | Batca | 482/99 |
| 2007/0117691 | A1 * | 5/2007 | Sechrest et al. | 482/97 |
| 2007/0135272 | A1 * | 6/2007 | Stuckey | 482/98 |
| 2007/0167299 | A1 * | 7/2007 | Simonson et al. | 482/100 |
| 2008/0051265 | A1 * | 2/2008 | Webber | 482/99 |
| 2008/0051266 | A1 * | 2/2008 | Ish et al. | 482/99 |
| 2008/0051267 | A1 * | 2/2008 | Ish | 482/99 |
| 2008/0051268 | A1 * | 2/2008 | Ish | 482/99 |
| 2008/0051269 | A1 * | 2/2008 | Lines | 482/99 |
| 2008/0096735 | A1 * | 4/2008 | Grider | 482/99 |

* cited by examiner

*Primary Examiner*—Loan H Thanh
*Assistant Examiner*—Daniel F Roland
(74) *Attorney, Agent, or Firm*—Andrus, Sceales, Starke & Sawall, LLP

(57) ABSTRACT

Exercise apparatus and an assembly method therefor have a resistance-bearing cable running along an extension arm and trained around a pulley for bearing resistance for an exercise routine. The pulley is swivelable about a swivel axis along a shank mounted to the arm by a bearing housing cartridge supporting and locating the shank and insertable into a hollow end of the extension arm along an insertion direction coincident with the extension axis and the swivel axis and supporting the pulley for swiveling about the swivel axis along the shank.

5 Claims, 6 Drawing Sheets

EXERCISE APPARATUS WITH CARTRIDGE LOADING PULLEY SWIVEL

BACKGROUND AND SUMMARY

The invention relates to exercise apparatus.

Exercise apparatus is known in the prior art including an extension arm extending along an extension axis and having a resistance-bearing cable running therealong for bearing resistance for an exercise routine. The extension arm has a swivel pulley mounted thereto, and the cable is trained around the pulley. The pulley is swivelable about a swivel axis coincident with the extension axis. The pulley has a pulley wheel rotatable about a rotation axis normal to the swivel axis. The cable feeds out in one direction of rotation of the pulley wheel, and takes up in the opposite direction of rotation of the pulley wheel. It is known in the prior art to provide a swivel pulley bracket mounted to a fixed housing that is machined and welded to the arm through which the cable tracks.

The present invention provides improvements in the mounting of the swivel pulley to the noted extension arm, including simplification and cost reduction.

DETAILED DESCRIPTION

Figure 1:
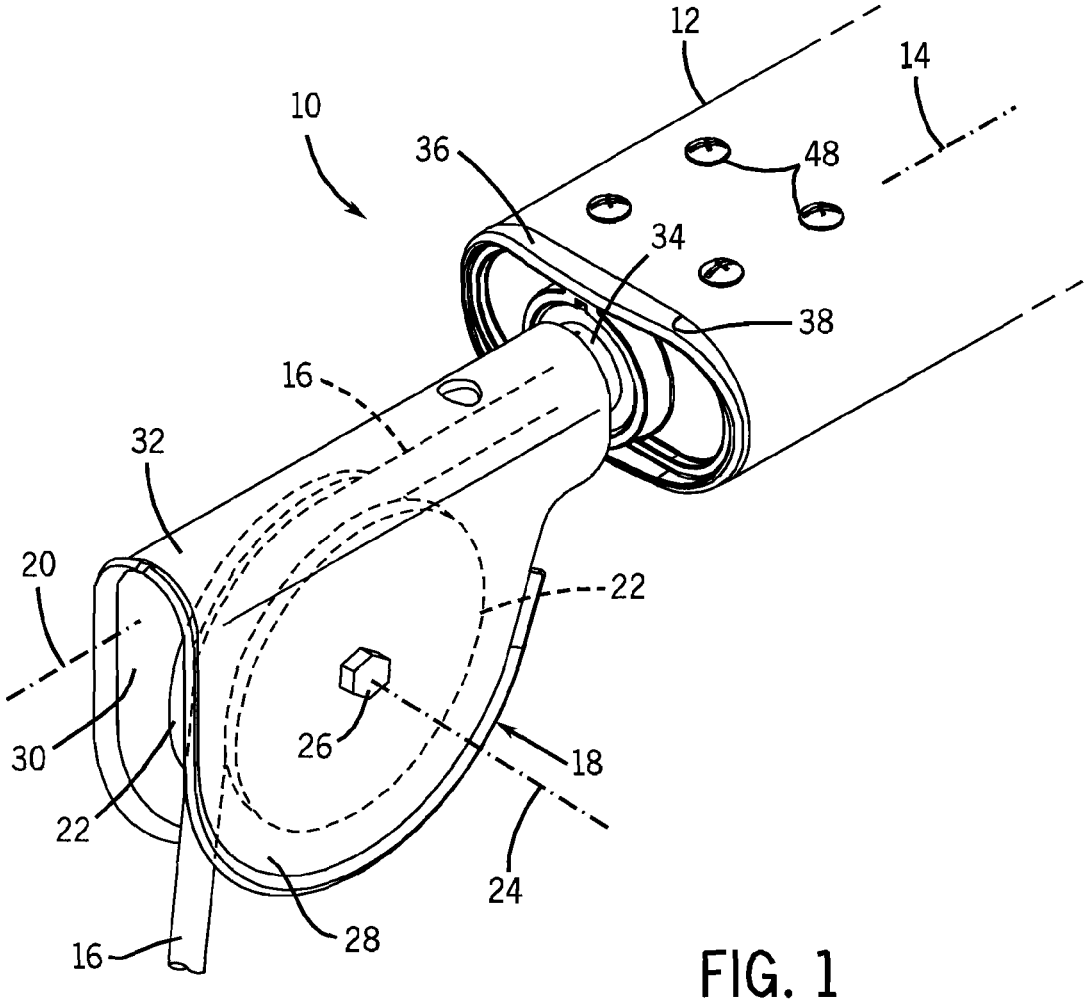
FIG. 1 is a perspective view of a portion of an exercise apparatus constructed in accordance with the invention, including an extension arm having a swivel pulley mounted thereto.

FIG. 1 shows exercise apparatus 10 including an extension arm 12 extending along an extension axis 14 and having a resistance-bearing cable 16 running therealong for bearing resistance for an exercise routine. For example, the left end of the cable 16 is connected to a handle gripped by the user to pull the cable, and the other end of the cable is connected to a weight stack such that one or more weights are lifted against gravity when the cable handle is pulled by the user, as is known. The extension arm has a swivel pulley 18 mounted thereto. Cable 16 is trained around the pulley. The pulley is swivelable about a swivel axis 20 coincident with extension axis 14. The pulley has a pulley wheel 22 rotatable about a rotation axis 24 normal to swivel axis 20, and with cable 16 feeding out (leftwardly and downwardly in FIG. 1) in one direction of rotation (counterclockwise) of pulley wheel 22, and with cable 16 taking up (upwardly and rightwardly in FIG. 1) in the opposite direction of rotation (clockwise) of pulley wheel 22, all as is known. Pulley wheel 22 is mounted by an axle bolt 26 extending between facing halves 28 and 30 of pulley block or saddle 32. Pulley block 32 has a shank 34, FIG. 2, welded thereto and extending along swivel axis 20. Shank 34 is a hollow tubular member receiving cable 16 extending axially therethrough.

Figure 2:
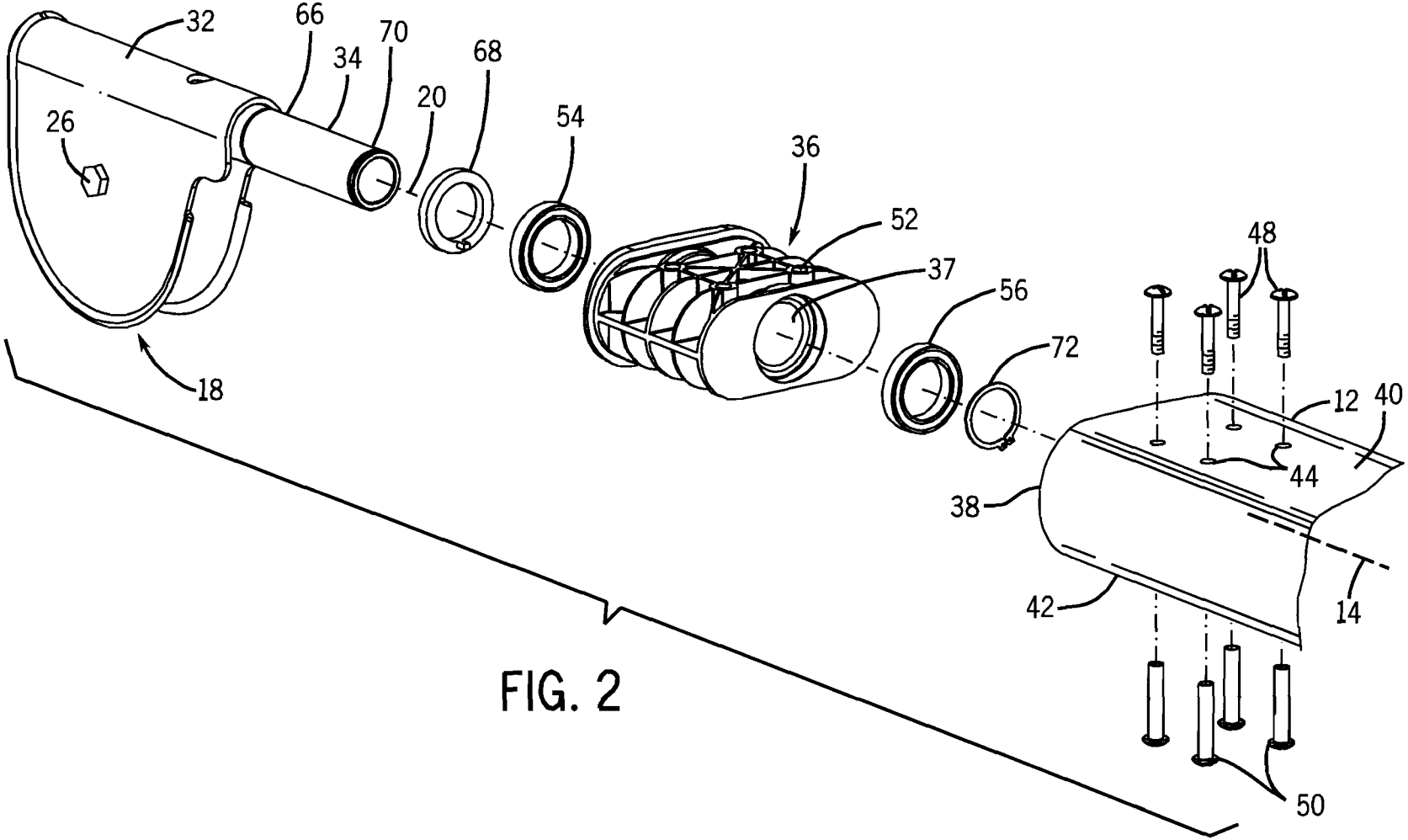
FIG. 2 is an exploded perspective view of the assembly of FIG. 1.
Figure 3:
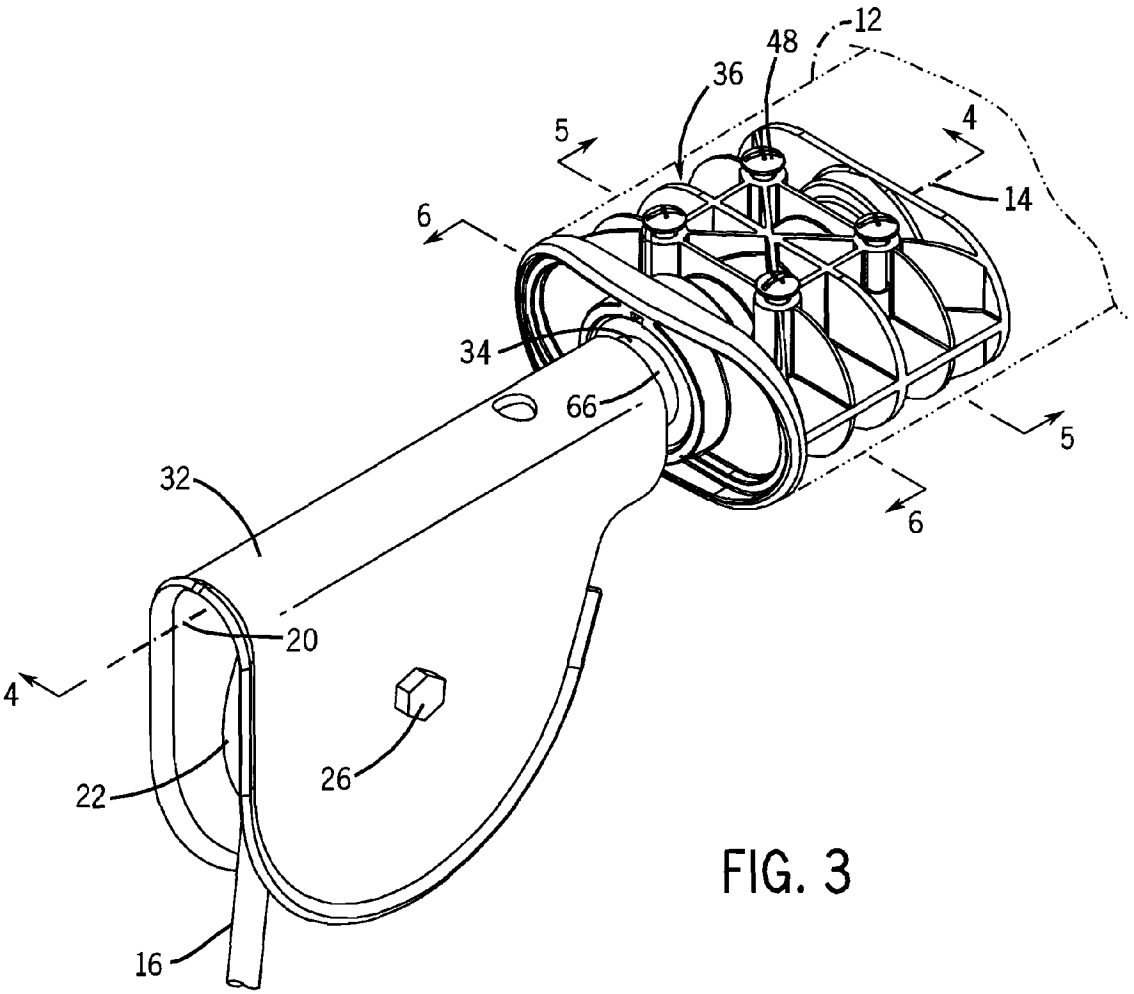
FIG. 3 is like FIG. 1 but with a portion of the extension arm cut-away to show the bearing housing cartridge.

Shank 34 is mounted to arm 12 by a bearing housing 36, FIGS. 2, 3, supporting and locating the shank and secured to arm 12 to support pulley 18 for swiveling about swivel axis 20 along shank 34. Arm 12 is hollow, including at the end 38 thereof. The hollow arm guides cable 16 therethrough, including through hollow end 38. Bearing housing 36 is a cartridge insertable into hollow end 38 of arm 12 along an insertion direction (rightwardly in FIG. 2) coincident with extension axis 14 and swivel axis 20. In the preferred embodiment, hollow end 38 of arm 12 has a noncircular cross-sectional shape providing keyed orientation of bearing housing cartridge 36 therein and preventing rotation of cartridge 36 about swivel axis 20. In one form, the noted shape is a racetrack shape, FIG. 5, though other noncircular cross-sectional shapes may be used to provide the noted keyed orientation. Hollow end 38 of arm 12 has sidewalls 40, 42, FIGS. 2, 4, 5, with a plurality of apertures such as 44, 46 therethrough aligned with cartridge 36. A plurality of bolts 48, 50 extend through respective apertures and engage and locate and secure cartridge 36 within hollow end 38 of arm 12. For example, the bolts may be provided by externally threaded bolt portions 48 received in internally threaded sleeve bolt portions 50 which extend through bores such as 52 through cartridge 36. Shank 34 is inserted into cartridge 36 (rightwardly along axis 20 in FIG. 2) followed by insertion of shank 34 and cartridge 36 as a subassembly along the noted insertion direction 20, 14 into hollow end 38 of arm 12.

Figure 4:
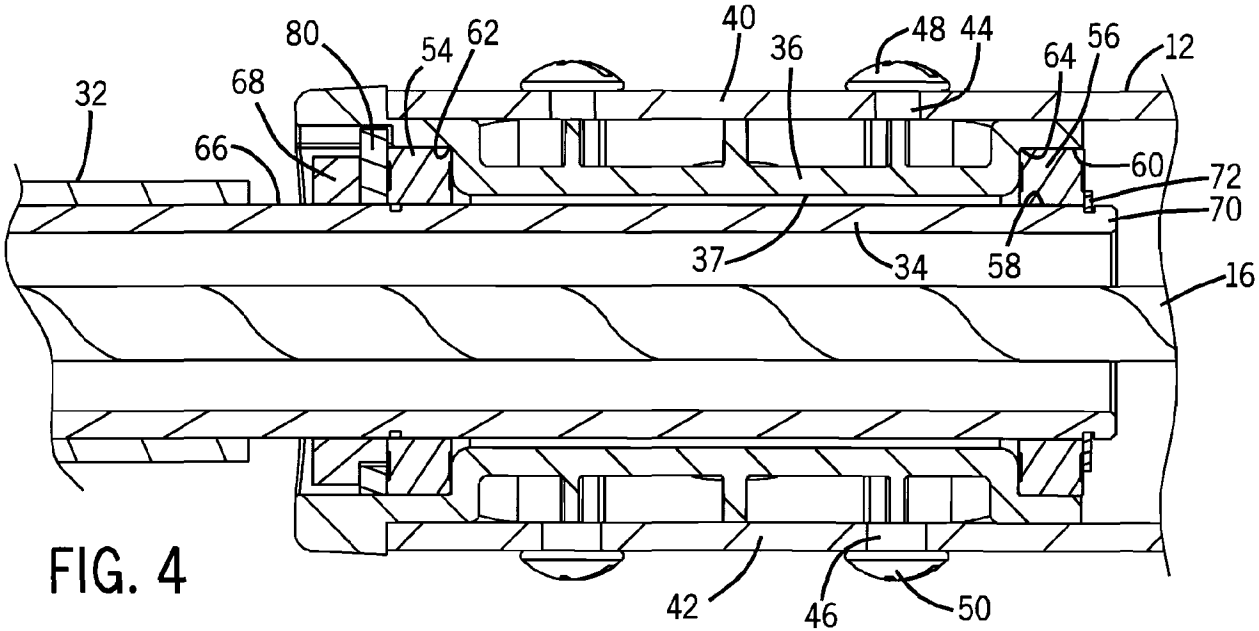
FIG. 4 is sectional view taken along line 4-4 of FIG. 3.
Figure 5:
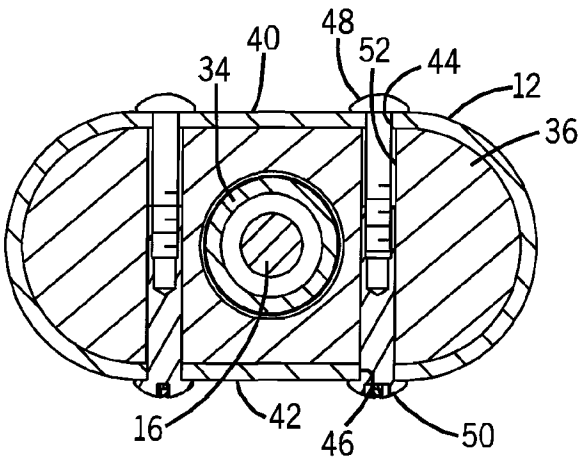
FIG. 5 is a sectional view taken along line 5-5 of FIG. 3.

First and second bearings 54 and 56, FIGS. 2, 4, are trapped between shank 34 and cartridge 36 and support the shank for rotation within the cartridge. Each bearing is preferably a roller bearing having an inner race at 58 engaging shank 34, and an outer race at 60 engaging cartridge 36. Bearings 54 and 56 are axially spaced from each other along shank 34. Cartridge 36 has first and second annular recessed channels 62 and 64 respectively receiving and locating bearings 54 and 56 at their noted respective outer races.

Shank 34 has an intermediate section 66, FIGS. 2-4, with an enlarged shoulder 68 thereon, e.g. provided by a ring welded thereon. Shoulder 68 is between pulley wheel 22 and cartridge 36. Shank 34 has an inner axial end 70 with a retaining ring 72, e.g. a snap ring, mounted thereon. Bearings 54 and 56 are axially slidable along shank 34 from inner axial end 70 prior to mounting of retaining ring 72 to inner axial end 70. Shoulder 68 and retaining ring 72 trap cartridge 36 and bearings 54, 56 therebetween and block axial movement of pulley 18 into and out of hollow end 38 of arm 12. Arm 12 preferably has an axial center line extending along extension axis 14, and cable 16 as it extends axially through hollow end 38 of arm 12 is along such center line.

Figure 6:
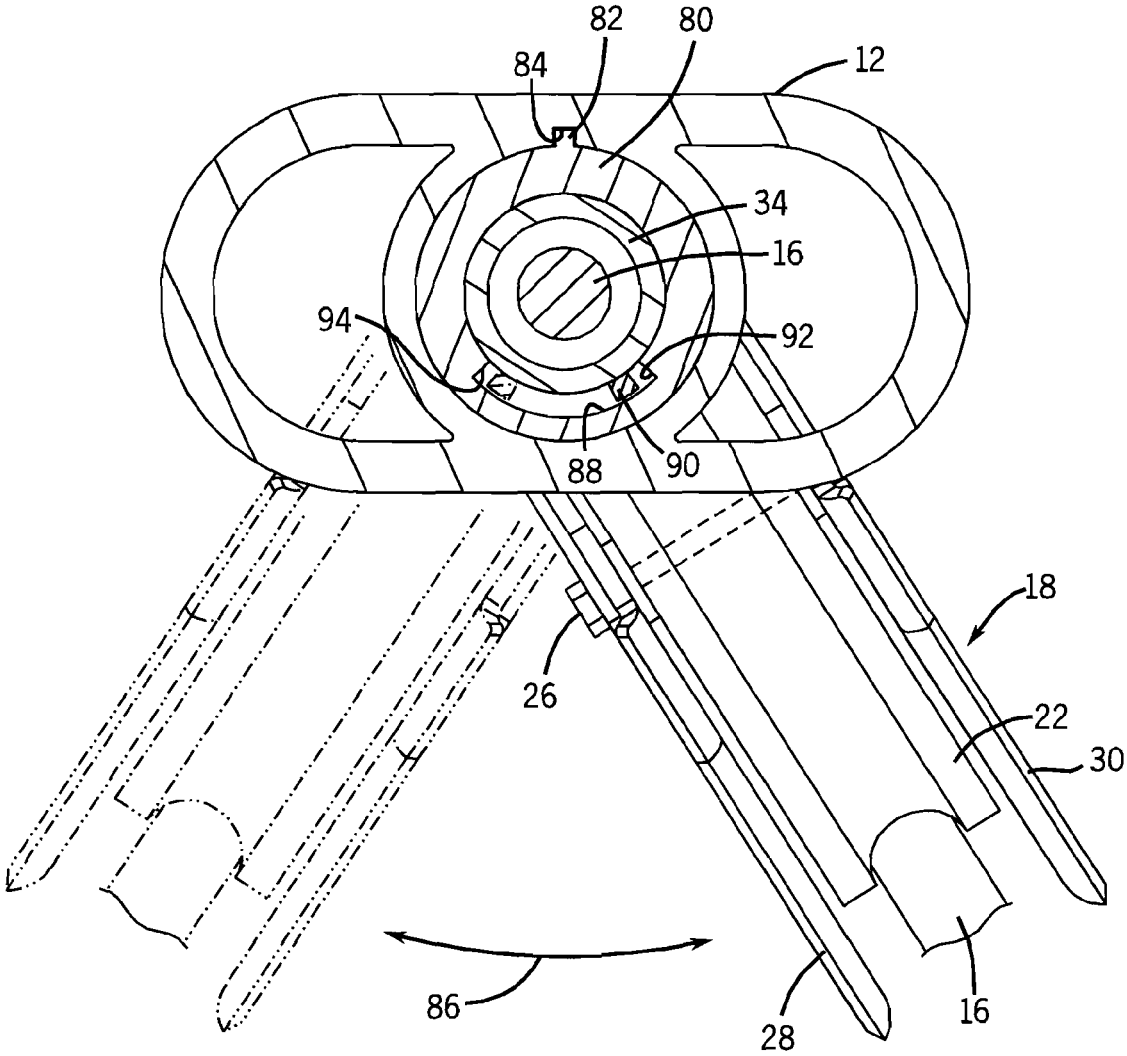
FIG. 6 is a sectional view taken along line 6-6 of FIG. 3.
Figure 7:
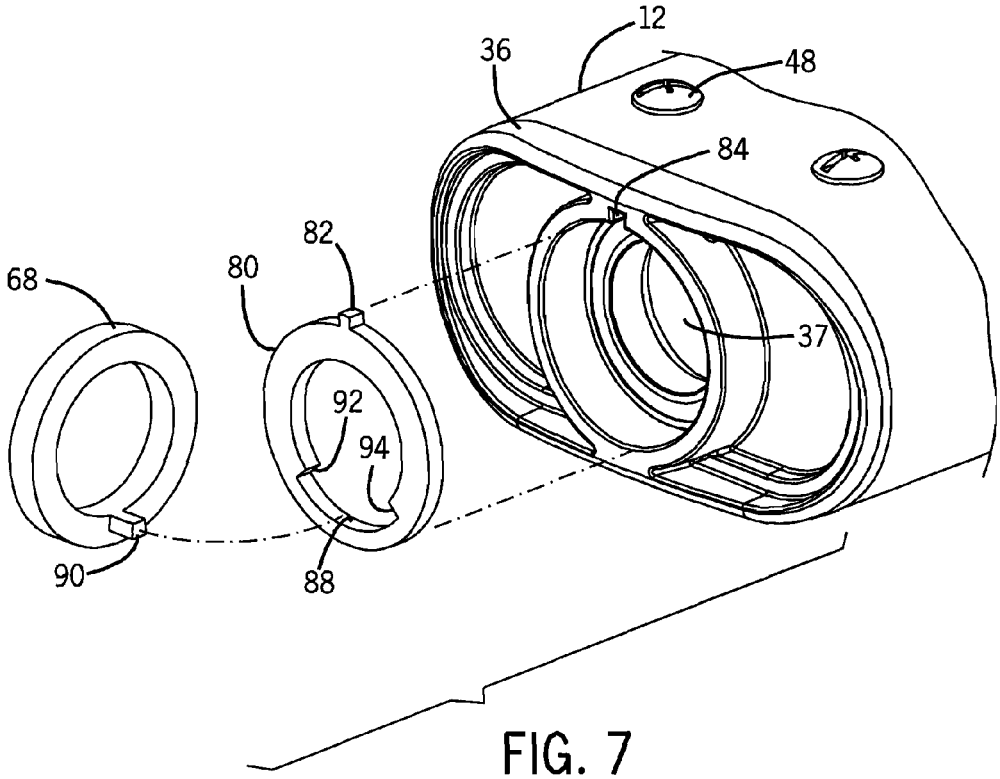
FIG. 7 is an exploded perspective view of a portion of the assembly of FIG. 3.

In one embodiment, it is desired to limit rotation of pulley 18 about swivel axis 20 along a limited arc less than 360°. In this embodiment, a rotation-limiter disk 80, FIG. 7, is captured by cartridge 36 in anti-rotation relation about swivel axis 20. Disk 80 is press fit into the axial end of the cartridge and held against rotation by tab 82 extending radially into notch 84 of the cartridge. Shank 34 extends axially through disk 80 for rotation therein about swivel axis 20. Shoulder 68 of the shank engages disk 80 in detent relation permitting rotation of shoulder 68 relative to disk 80 only along a limited arc, to limit rotation of shank 34 and pulley wheel 12 to a restricted arc 86, FIG. 6, about swivel axis 20. One of the disk and the shoulder has an arcuate slot formed therein, for example arcuate slot 88 formed in disk 80. The other of the disk and shoulder has a tab extending axially into the slot, for example, shoulder 68 having tab 90 extending axially into slot 88. Slot 88 has first and second distally arcuately spaced ends 92 and 94 providing the ends of the noted limited arc of rotation upon engagement by tab 90. Bearings 54 and 56 are trapped between shank 34 and cartridge 36, with each bearing having the noted inner race engaging the shank and the noted outer race engaging the cartridge. The cartridge has the noted annular recessed channels 62, 64 respectively receiving and locating the bearings 54, 56 at the noted respective outer races thereof. Shank 34 has the noted section 66 with shoulder 68 fixed thereon between pulley wheel 22 and cartridge 36. Disk 80 is axially between shoulder 68 and bearing 54, and disk 80 engages cartridge 36 in the noted keyed anti-rotation relation.

The system provides an assembly method for exercise apparatus 10 having an extension arm 12 extending along an extension axis 14 and having a resistance-bearing cable 16 running therealong for bearing resistance for an exercise routine, the extension arm 12 having a swivel pulley 18 mounted thereto, the cable being trained around the pulley, the pulley being swivelable about a swivel axis 20 coincident with the extension axis 14, the pulley have a pulley wheel 22 rotatable about a rotation axis 24 normal to the swivel axis 20. The assembly method includes providing the pulley with a shank 34 extending along the swivel axis 20, and mounting the shank to the arm 12 by a bearing housing 36 supporting and locating the shank and secured to the arm to support the pulley for swiveling about the swivel axis 20 along the shank 34. The bearing housing is provided as a modular cartridge 36 receiving shank 34 therein. Cartridge 36, with shank 34 pre-assembled thereto as a subassembly, is inserted into hollow end 38 of arm 12 along an insertion direction coincident with extension axis 14 and swivel axis 20. The method includes aligning apertures 44, 46 with bores 52 through the cartridge, and extending bolts 48, 50 through respective apertures and bores and engaging and locating and securing cartridge 36 within hollow end 38 of arm 12. The method includes initially inserting shank 34 into cartridge 36 through axial bore 37 therein, and then inserting shank 34 and cartridge 36 as a subassembly along the noted insertion direction 14 into hollow end 38 of arm 12. In the assembly sequence, shoulder ring 68, FIG. 2, is slid axially leftwardly along shank 34 and welded thereto at the noted section 66, to provide a subcomponent. And then cartridge 36 and bearings 54, 56 and disk 80 are slid axially leftwardly in FIG. 2 along shank 34 (i.e. shank 34 is inserted into disk 80, bearing 54, cartridge 36, bearing 56), and then the retaining ring provided by snap ring 72 is mounted to shank 34 at its outer axial end 70, to provide a subassembly of cartridge 36 and shank 34, whereafter such subassembly is inserted axially rightwardly along axis 14 into hollow end 38 of arm 12, followed by securement by bolts 48, 50.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An exercise apparatus for exercising against a resistance comprising an extension arm extending along an extension axis and having a resistance-bearing cable running therealong for bearing resistance for an exercise routine, said extension arm having a swivel pulley mounted thereto, said cable being trained around said pulley, said pulley being swivelable about a swivel axis coincident with said extension axis, said pulley having a pulley wheel rotatable about a rotation axis normal to said swivel axis, said cable feeding out in one direction of rotation of said pulley wheel and taking up in the opposite direction of rotation of said pulley wheel, said pulley having a shank extending along said swivel axis and mounted to said arm by a bearing housing supporting and locating said shank and secured to said arm to support said pulley for swiveling about said swivel axis along said shank, wherein said arm is hollow, including at an end thereof, and said hollow arm guides said cable therethrough, including through said hollow end, and wherein said bearing housing is a cartridge insertable into said hollow end of said arm along an insertion direction coincident with said extension axis and said swivel axis, and comprising a rotation-limiter disk captured by said cartridge in anti-rotation relation about said swivel axis, said shank extending through said disk for rotation therein about said swivel axis, said shank having a shoulder engaging said disk in detent relation permitting rotation of said shoulder relative to said disk only along a limited arc, to limit rotation of said shank and said pulley wheel to a restricted arc about said swivel axis.

2. The exercise apparatus according to claim 1 wherein one of said disk and said shoulder has an arcuate slot formed therein, and the other of said disk and said shoulder has a tab extending axially into said slot, said slot having first and second distally arcuately spaced ends providing the ends of said limited arc of rotation upon engagement by said tab.

3. The exercise apparatus according to claim 1 comprising first and second bearings trapped between said shank and said cartridge, said bearings each having an inner race engaging said shank and an outer race engaging said cartridge, said cartridge having first and second annular recessed channels respectively receiving and locating said first and second bearings at respective said outer races thereof, said shank having a section with said shoulder fixed thereon between said pulley wheel and said cartridge, said disk being axially between said shoulder and said first bearing, said disk engaging said cartridge in keyed anti-rotation relation.

4. An assembly method for an exercise apparatus for exercising against a resistance having an extension arm extending along an extension axis and having a resistance-bearing cable running therealong for bearing resistance for an exercise routine, said extension arm having a swivel pulley mounted thereto, said cable being trained around said pulley, said pulley being swivelable about a swivel axis coincident with said extension axis, said pulley having a pulley wheel rotatable about a rotation axis normal to said swivel axis, said cable feeding out in one direction of rotation of said pulley wheel and taking up in the opposite direction of rotation of said pulley wheel, said assembly method comprising providing said pulley with a shank extending along said swivel axis, and mounting said shank to said arm by a bearing housing supporting and locating said shank and secured to said arm to support said pulley for swiveling about said swivel axis along said shank, providing said arm as a hollow arm, including at an end thereof, said hollow arm guiding said cable therethrough, including through said hollow end, and comprising providing said bearing housing as a modular cartridge receiving said shank therein, and comprising providing a rotation-limiter disk, and capturing said disk with said cartridge in anti-rotation relation about said swivel axis, extending said shank through said disk for rotation therein about said swivel axis, providing said shank with a shoulder and engaging said shoulder and said disk in detent relation and permitting rotation of said shoulder relative to said disk only along a limited arc, to limit rotation of said shank and said pulley wheel to a restricted arc about said swivel axis.

5. The assembly method according to claim 4 comprising providing one of said disk and said shoulder with an arcuate slot formed therein, providing the other of said disk and said shoulder with an axially extending tab, extending said tab axially into said slot, providing said slot with first and second distally arcuately spaced ends providing the ends of said limited arc of rotation upon engagement by said tab.

* * * * *